United States Patent [19]

Mabe et al.

[11] Patent Number: 4,904,164

[45] Date of Patent: Feb. 27, 1990

[54] SCROLL TYPE COMPRESSOR WITH VARIABLE DISPLACEMENT MECHANISM

[75] Inventors: Atsushi Mabe; Kiyoshi Terauchi, both of Isesaki, Japan

[73] Assignee: Sanden Corporation, Gunma, Japan

[21] Appl. No.: 213,337

[22] Filed: Jun. 30, 1988

[30] Foreign Application Priority Data

Jun. 30, 1987 [JP] Japan ..... 62-160968

[51] Int. Cl.[4] ..... F04B 49/02; F04B 49/08; F04C 18/04

[52] U.S. Cl. ..... 417/308; 417/309; 417/310; 418/55

[58] Field of Search ..... 417/310, 440, 308, 309; 418/55 R

[56] References Cited

U.S. PATENT DOCUMENTS

| | | | |
|---|---|---|---|
| 3,759,057 | 9/1973 | English et al. | 62/196 |
| 4,383,805 | 5/1983 | Teegarden et al. | 417/308 |
| 4,431,388 | 2/1984 | Eber et al. | 418/55 |
| 4,459,817 | 7/1984 | Inagaki et al. | 62/196.3 |
| 4,468,178 | 8/1984 | Hiraga et al. | 417/440 |
| 4,496,296 | 1/1985 | Arai et al. | 418/55 |
| 4,505,651 | 3/1985 | Terauchi et al. | 417/440 |
| 4,557,670 | 2/1985 | Inagaki et al. | 417/299 |
| 4,566,863 | 1/1986 | Goto et al. | 417/295 |
| 4,642,034 | 2/1987 | Terauchi | 417/295 |
| 4,673,340 | 6/1987 | Mabe et al. | 418/15 |
| 4,717,314 | 1/1988 | Sato et al. | 417/310 |
| 4,744,733 | 5/1988 | Terauchi et al. | 417/310 |

FOREIGN PATENT DOCUMENTS 60-101295 5/1985 Japan .

*Primary Examiner*—John J. Vrablik

*Attorney, Agent, or Firm*—Banner, Birch, McKie & Beckett

[57] ABSTRACT

A variable displacement type compressor is disclosed. The compressor includes a housing having fluid inlet and fluid outlet ports. A fixed scroll is disposed within the housing and has a circular end plate from which a first spiral element extends. The end plate of the fixed scroll partitions the inner chamber of the compressor housing into a front chamber connected to the fluid inlet port and a rear chamber. The rear chamber is divided into a discharge chamber connected to the fluid outlet port and an intermediate pressure chamber. The end plate of the fixed scroll has at least two holes which connect the fluid pockets to the intermediate pressure chamber. The end plate also has a communicating channel which connects the front chamber to the intermediate chamber. A control device controls the communication between the front chamber and intermediate pressure chamber. The control device is disposed on the intermediate pressure chamber and comprises first and second valve elements. The first valve element of the control device is operated by pressure from the discharge chamber. Pressure from the discharge chamber is controlled by the second valve element. The first valve element includes a cylinder and a piston slidably disposed within the cylinder. The cylinder has first and second openings. The first opening is formed at the intermediate pressure chamber side. The second opening is formed at the communicating channel side. A bottom end of the piston closes the second opening, when a top end of the piston receives discharge gas pressure.

10 Claims, 3 Drawing Sheets

SCROLL TYPE COMPRESSOR WITH VARIABLE DISPLACEMENT MECHANISM

TECHNICAL FIELD

The present invention relates to a scroll type compressor. More particularly, the present invention relates to a scroll type compressor with a variable displacement mechanism.

BACKGROUND OF THE INVENTION

A scroll type compressor with a variable displacement mechanism is well known in the art. For example, U.S. Pat. No. 4,744,733 shows such a compressor.

In U.S. Pat. No. 4,744,733, the variable displacement mechanism comprises both first and second valve elements. The second valve element controls the motion of the first valve element. The first valve element comprises a cylinder and a piston slidably disposed within the cylinder. A top of the piston of the first valve element receives varied pressure of a compressed fluid in the discharge chamber by virtue of the second valve element. The cylinder of the first valve element has both first and second openings. The first opening is formed at an intermediate pressure chamber side. The second opening is formed at a communication channel side. The bottom of the piston of the first valve element blocks the first opening of the cylinder of the first valve element when the top of the piston of the first valve element receives the pressure of the compressed fluid in the discharge chamber.

In this variable displacement mechanism, there are mainly two problems as described in the following. One problem is in firmly blocking the first opening of the cylinder by the bottom of the piston, because of being small pressure difference between the discharge chamber pressure and the intermediate chamber pressure.

Furthermore, U.S. Pat. No. 4,505,651 shows another variable displacement mechanism. This variable displacement mechanism comprises one valve element as an electromagnetic valve directly controlling the opening and closing of a communicating hole formed at a circular end plate of a fixed scroll. This mechanism cannot obtain a firm block of the communicating hole which communicates between a suction chamber and an intermediate chamber, because of directly controlling of the opening and the closing of the communicating hole.

Another problem is a fluttering of the piston when the piston begins opening. This fluttering of the piston happens by a quick change of pressure which pushes the bottom of the piston.

SUMMARY OF THE INVENTION

It is a primary object of the present invention to obtain a firm blocking between a suction chamber and an intermediate pressure chamber.

It is another object of the present invention to prevent a fluttering of a valve element of a compression ratio control mechanism.

A scroll type compressor according to the present invention includes a housing having an inlet port and an outlet port. A fixed scroll is disposed within the housing and has a circular end plate from which a first spiral element extends. An orbiting scroll having a circular end plate from which a second spiral element extends is placed on a drive shaft. The two spiral elements interfit at an angular and radial offset to form a plurality of line contacts and to define at least one pair of fluid pockets within the interior of the housing.

The housing includes mechanisms for driving the orbiting scroll and for preventing rotation of the orbiting scroll. A driving mechanism is operatively connected to the orbiting scroll to effect orbital motion of the orbiting scroll and to change the volume of the fluid pockets during orbital motion. A rotation preventing mechanism prevents rotation of the orbiting scroll.

The circular end plate of the fixed scroll divides the interior of the housing into a front chamber and a rear chamber. The front chamber communicates with a fluid inlet port. The rear chamber is divided into a discharge chamber which communicates with a fluid outlet port and a central fluid pocket formed by both scrolls, and an intermediate pressure chamber. At least one pair of holes is formed through the circular end plate of the fixed scroll to form a fluid channel between the fluid pockets and the intermediate pressure chamber. A communicating channel formed through the circular end plate of the fixed scroll provides a fluid channel between the intermediate pressure chamber and the front chamber.

A control mechanism disposed on a portion of the intermediate pressure chamber controls opening and closing of the communicating channel. The control mechanism comprises a first valve element and a second valve element. The first valve element of the control mechanism is operated by pressure from the discharge chamber. Pressure from the discharge chamber is controlled by the second valve element. The first valve element includes a cylinder and a piston slidably disposed within the cylinder. The cylinder has a first opening formed at the intermediate pressure chamber side and a second opening formed at the communicating channel side. The bottom end of the piston closes the second opening, when the top end of the inner piston receives discharge gas pressure.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

DETAILED DESCRIPTION OF THE PREFERRED EMBODIMENTS

Figure 1:
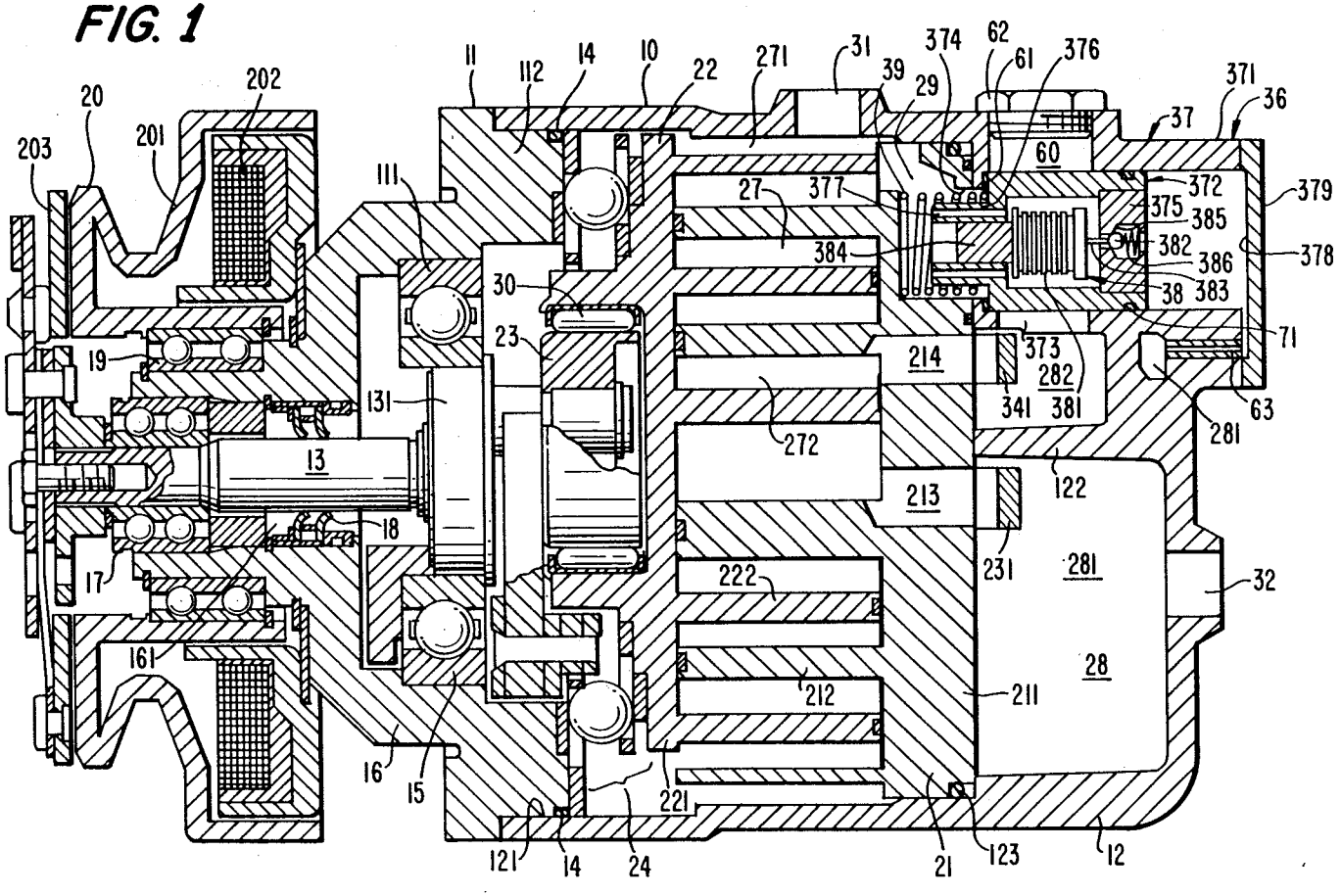
FIG. 1 is a vertical longitudinal sectional view of a scroll type compressor in accordance with one embodiment of this invention, illustrating the bottom of a piston of a first valve element blocking a second opening of a cylinder of a first valve element.

Referring to FIG. 1, a scroll type compressor according to one embodiment of this invention is shown. The scroll type compressor includes a compressor housing 10 having a front end plate 11 and a cup-shaped casing 12 which is attached to an end surface of end plate 11. An opening is formed in the center of front end plate 11 and drive shaft 13 is disposed in opening 111. An annular projection 112 is formed in a rear surface of front end plate 11. Annular projection 112 faces cup-shaped casing 12 and is concentric with opening 111. An outer peripheral surface of projection 112 extends into an inner wall of opening 121 of cup-shaped casing 12. Opening 121 of cup-shaped casing 12 is covered by front end plate 11. An O-ring 14 is placed between the outer peripheral surface of annular projection 112 and an inner wall of opening 121 of cup-shaped casing 12 to seal the mating surface of front end plate 11 and cup-shaped casing 12.

An annular sleeve 16 longitudinally projects from a front end surface of front end plate 11, surrounds drive shaft 13, and defines a shaft seal cavity 161.

Drive shaft 13 is rotatably supported by annular sleeve 16 through a bearing 17 located within the front end of sleeve 16. Drive shaft 13 has a disk-shaped rotor 131 at its inner end which is rotatably supported by front end plate 11 through a bearing 15 located within opening 111 of front end plate 11. A shaft seal assembly 18 is coupled to drive shaft 13 within shaft seal cavity 161 of annular sleeve 16.

A pulley 201 is rotatably supported by a ball bearing 19 which is carried on the outer peripheral surface of annular sleeve 16. An electromagnetic coil 202 is fixed about the outer surface of annular sleeve 16 by a support plate. An armature plate 203 is elastically supported on the outer end of drive shaft 13. Pulley 201, electromagnetic coil 202 and armature plate 203 form an electromagnetic clutch 20. In operation, drive shaft 13 is driven by an external power source, for example, the engine of an automobile, through a rotation transmitting device such as electromagnetic clutch 20.

A fixed scroll 21, an orbiting scroll 22 and a rotation preventing/thrust bearing mechanism 24 for orbiting scroll 22 are disposed in the interior of housing 10.

Fixed scroll 21 includes a circular end plate 211 and spiral element 212 affixed to or extending from one end surface of circular end plate 211. Fixed scroll 21 is fixed within the inner chamber of cup-shaped casing 12 by screws (not shown) screwed into end plate 211 from the outside of cup-shaped casing 12. An O-ring 123 is disposed between an outer peripheral surface of circular end plate 211 and an inner peripheral wall of cup-shaped casing 12. Therefore, circular end plate 211 of fixed scroll 21 insulatingly partitions the inner chamber of cup-shaped casing 12 into two chambers, a front chamber 27 and a rear chamber 28. Spiral element 212 of fixed scroll 21 is located within front chamber 27.

A partition wall 122 longitudinally projects from the inner end surface of cup-shaped casing 12 to divide rear chamber 28 into a discharge chamber 281 and an intermediate chamber 282. The end surface of partition wall 122 contacts the rear end surface of circular end plate 211.

Orbiting scroll 22, which is located in front chamber 27, includes a circular end plate 221 and a spiral element 222 extending from one end surface of circular end plate 221. Spiral element 222 of orbiting scroll 22 and spiral element 212 of fixed scroll 21 interfit at an angular offset of approximately 180° and a predetermined radial offset, form sealed spaces between spiral element 212 and 222. Orbiting scroll 22 is rotatably supported by bushing 23, which is eccentrically connected to the inner end of disc-shaped portion 131 through a radial needle bearing 30. While orbiting scroll 22 orbits, rotation is prevented by a rotation preventing/thrust bearing mechanism 24 which is placed between the inner end surface of front end plate 11 and circular end plate 221 of orbiting scroll 22.

Compressor housing 10 is provided with an inlet port 31 and an outlet port 32 for connecting the compressor to an external refrigeration circuit. Refrigeration fluid from the external circuit is introduced into a suction chamber 271 through inlet port 31 and flows into sealed spaces formed between spiral elements 212 and 222 through open spaces between the spiral elements. The spaces between the spiral elements sequentially open and close during the orbital motion of orbiting scroll 22. When these spaces are open, fluid to be compressed flows into these spaces but no compression occurs. When the spaces are closed, no additional fluid flows into these spaces and compression begins. Since the location of the outer terminal ends of spiral elements 212 and 222 is at a final involute angle, location of the spaces is directly related to the final involute angle. Furthermore, refrigeration fluid in the sealed space is moved radially inwardly and is compressed by the orbital motion of orbiting scroll 22. Compressed refrigeration fluid at the center sealed space is discharged to discharge chamber 281 past valve plate 231 through discharge port 213 which is formed at the center of circular end plate 211.

A pair of holes (only one hole is shown as hole 214) are formed in circular end plate 211 of fixed scroll 21 and are symmetrically placed so that an axial end surface of spiral element 222 of orbiting scroll 22 simultaneously crosses over both holes. Hole 214 and the other hole communicate between the sealed space and intermediate pressure chamber 282. Hole 214 is placed at a position defined by involute angle ($\phi_1$) (not shown) and opens along the inner side wall of spiral element 212. The other hole is placed at a position defined by involute angle ($\phi_1 \cdot \pi$) and opens along the outer side wall of spiral element 212. A pair of valve plates (only one valve plate is shown as valve plate 341) are attached by fasteners (not shown) to the end surface of circular end plate 211 opposite hole 214 and the other hole, respectively. Valve plate 341 and the other valve plate (not shown) are made of a spring material so that the bias of valve plate 341 and the other valve plate push them against the opening of hole 214 and the other hole to close each hole.

When the valve plate is pushed by virtue of a pressure difference, valve retainer **231*a*, 341*a*** receives the valve plate to prevent excessive bending of the valve plate. Excessive bending of the valve plate can cause damage to the valve plate.

Circular end plate 211 of fixed scroll 21 also has communicating channel 29 formed at an outer side portion of the terminal end of spiral element 212. The communicating channel 29 is provided for communication between a suction chamber 271 and an intermediate pressure chamber 282. A control mechanism 36 controls fluid communication between suction chamber 271 and intermediate pressure chamber 282.

Control mechanism 36 comprises a first valve element 37 having a cylinder 371 and a piston 372 slidably disposed within cylinder 371, and a second valve element 38.

A first opening 373 which opens to intermediate pressure chamber 282 is formed at a side wall of cylinder 371. A second opening 374 which opens to communicating channel 29 is formed at a bottom portion of cylinder 371. A ring member 61 having sealing function is disposed on an inner surface of the bottom portion of cylinder 371. An axial annular projection 376 outwardly projects from the bottom portion of piston 372. A plurality of communicating holes 377 are formed at axial annular projection 376 and communicate between inner and outer spaces of piston 372. A bias spring 39 is disposed between a rear end surface f circular end plate 211 and the bottom portion of piston 372 to urge piston 372 toward a ceiling 379 of cylinder 371. An opening 60 is formed for drilling first opening 373. After drilling, opening 40 is blocked by a plug 62. A hollow portion 378 is formed at an inner surface of ceiling 379 of cylinder 371 in order to be able to lead discharge gas into cylinder 371, even if an upper portion 375 of piston 372 contacts the inner surface of ceiling 379 of cylinder 371. An orifice tube 63 is disposed in the side wall of cylinder 371 to lead discharge gas to hollow portion 378 from discharge chamber 281.

Second valve element 38 comprises a bellows 381 and a needle-ball type valve 382 attached at a top of bellows 381 by pin member 383 is disposed within piston 372. The bottom of bellows 381 having a male screw portion 384 screws into an inner surface of axial annular projection 376. An initial condition of bellows 381 is adjustable by adjustment of screwing. A valve seat 385 is formed at upper portion 375 of piston 372. A bias spring 386 is disposed within valve seat 385 and urges needle-ball type valve 382 which locates within valve seat 385 toward the left side in relating to FIG. 1, i.e., toward a valve seat 385 closing stage.

In addition, a seal ring member 71 is disposed at an upper outer peripheral wall of piston 372 to seal a gap between an inner peripheral surface of cylinder 371 and the outer peripheral wall of piston 372.

The operation of control mechanism 36 is as follows. When the compressor is driven in a condition of suction gas pressure being high, i.e., heat load being large, bellows 381 is contracted by raised suction gas pressure which is led into the inner space of piston 372 from communicating channel 29 through communicating holes 377. In result, needle-ball type valve 382 blocks valve seat 385. Therefore, discharge gas pressure led into cylinder 371 through orifice tube 63 presses an outer surface of upper portion 375 of piston 372 to downward (leftward in relating to FIG. 1) against the restoring force of bias spring 39. Finally, first and second openings 373, 374 are blocked by piston 372, i.e., the communication between suction chamber 271 and intermediate pressure chamber 282 is prevented. Therefore, the pressure in intermediate pressure chamber 282 gradually increases due to fluid passage from intermediate sealed spaces 272 through hole 214 and the other hole. This passage of compressed fluid continues until the pressure in intermediate pressure chamber 282 is equal to the pressure in intermediate sealed spaces 272. When pressure equalization occurs, hole 214 and the other hole are closed by the spring tension of valve plate 341 and the other valve plate. Compression then operates normally and the displacement volume of sealed spaces is the same as the displacement volume when the terminal end of each spiral element 212, 222 first contacts outer spirals. In this situation, the downward force of piston 372 occurred by discharge gas pressure fully overcomes the upward force of piston 372 occurred by suction gas pressure which upwardly presses the bottom portion of piston 372 and the restoring force of bias spring 39.

Figure 2:
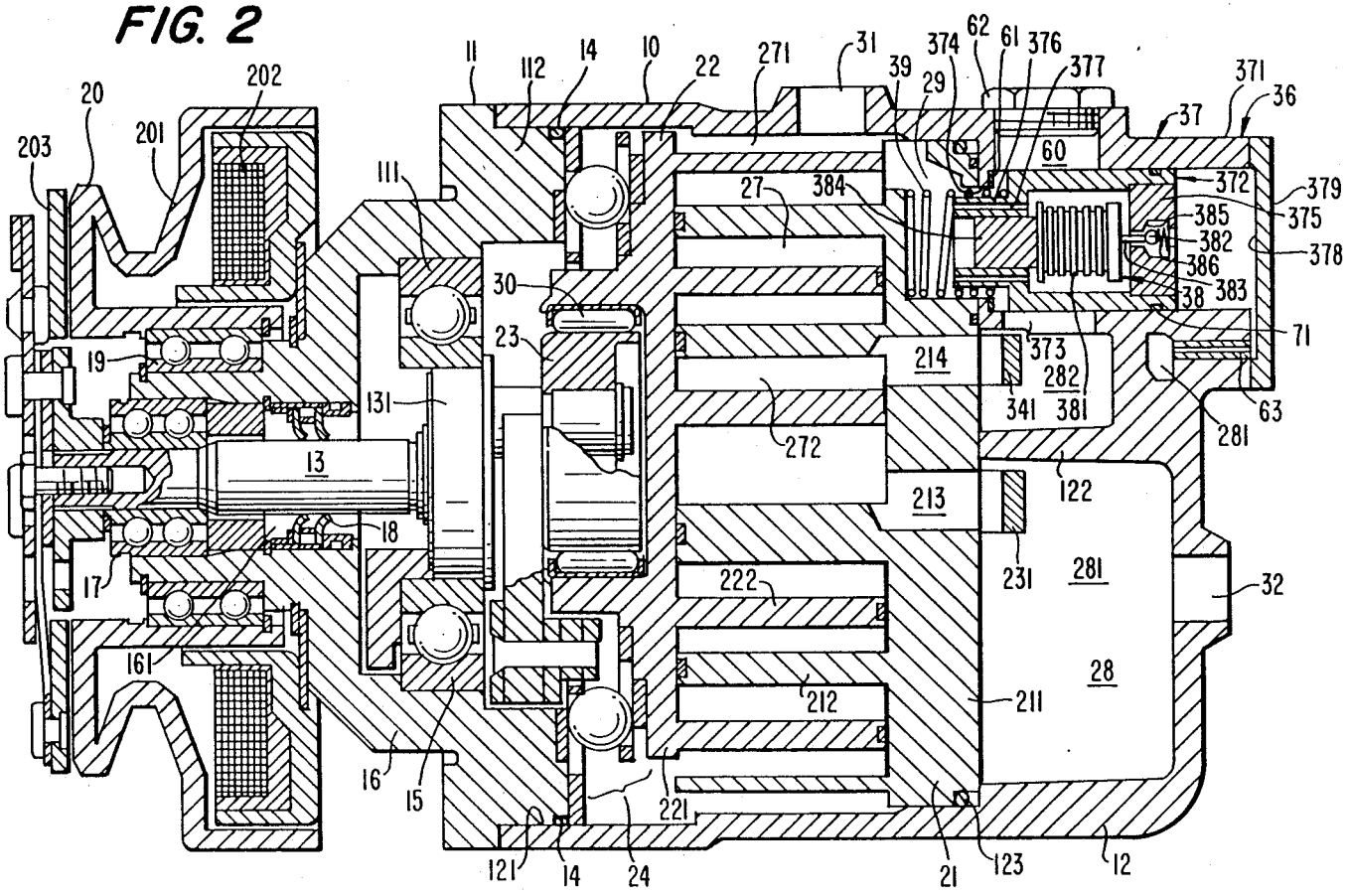
FIG. 2 is a vertical longitudinal sectional view of a scroll type compressor in accordance with FIG. 1, illustrating the bottom of the piston of the first valve element beginning to open the second opening of the cylinder of the first valve element.

Referring to FIG. 2, continuation of this non-reduced displacement stage makes heat load go down, i.e., suction gas pressure falls. In result, bellows 381 is expanded by fallen suction gas pressure which is led into the inner space of piston 372 from communicating channel 29 through communicating holes 377. Therefore, needle-ball type valve 382 moves rightward in relating to FIG. 2 and opens valve seat 385. When valve seat 385 is opened, discharge gas led into cylinder 371 through orifice tube 63 blows through to communicating channel 29 via valve seat 385, the inner space of piston 372 and communicating holes 377. Thus, downward force of piston 372 is reduced. In result, upward force of piston 372 occurred by suction gas pressure which upwardly presses the bottom portion of piston 372 and the restoring force of bias spring 39 overcomes the downward force of piston 372 occurred by reduced discharge gas pressure. Finally, first and second openings 373, 374 are opened, i.e., the communication between suction chamber 271 and intermediate pressure chamber 282 is obtained. When suction chamber 271 communicates intermediate pressure chamber 282, the pressure of intermediate pressure chamber 282 is extremely reduced. Thus, valve plate 341 is opened by virtue of the pressure difference between intermediate sealed spaces 272 and intermediate pressure chamber 282. Thus, refrigeration fluid in intermediate sealed spaces 272 flows into intermediate pressure chamber 282 through hole 214 and the other hole, and back into suction chamber 271. Therefore, the compression phase of the compressor starts after spiral element 222 of orbiting scroll 22 passes over hole 214 and the other hole. This greatly reduces the compression ratio of the compressor.

In the beginning stage of opening first and second openings 373, 374, there is no changing pressure which presses the bottom portion of piston 372. Therefore, fluttering which has happened in the prior art is completely eliminated.

Figure 3:
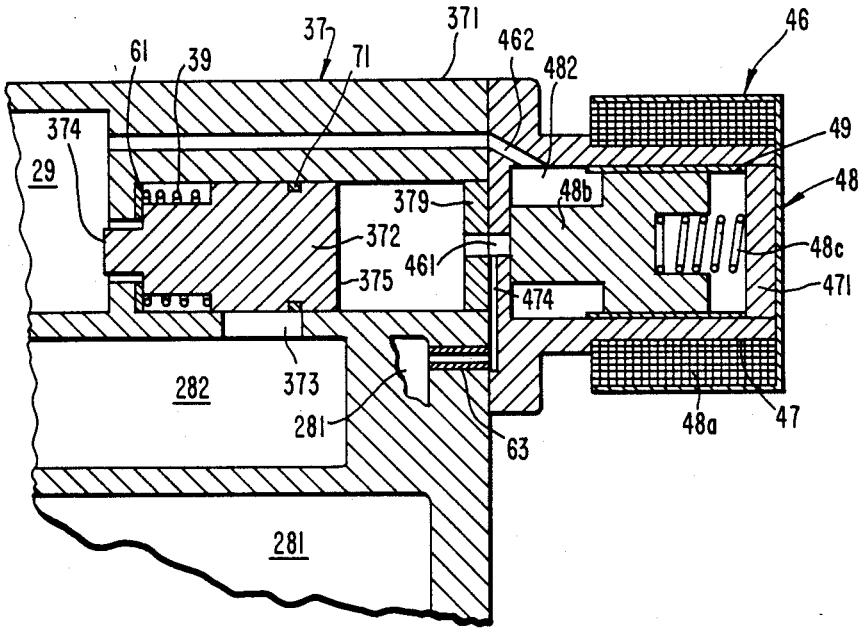
FIG. 3 is a cross-sectional view of an alternate embodiment of the variable displacement mechanism used in the scroll type compressor of FIG. 1.

Referring to FIG. 3, the second embodiment of a control mechanism 46 is shown. Control mechanism 46 comprises a first valve element 37 having cylinder 371 and piston 372 slidably disposed within cylinder 371, and a second valve element 48. Second valve element 48 is disposed on ceiling 379 of cylinder 371 and comprises a cylinder 47, a coil **48*a* and an armature 48*b*. Coil 48*a* surrounds an outer peripheral surface of cylinder 47. A bias spring 48*c* is disposed between a ceiling 471 of cylinder 47 and armature 48*b*. Armature 48*b* is slidably fitted within an inner surface of cylinder 47 through a cylindrical sealing member 49 and is urged downwardly to close an aperture 461 by the restoring force of coil 48*c*. An aperture 461 is connected to discharge chamber 281 through a first connecting conduit 474 and an orifice tube 63. A second connecting conduit 462 is opened at a lower inner surface of cylinder 47 and communicates an operating chamber 482 and communicating channel 29**.

During operation of the compressor, a small amount of compressed fluid which is discharged from discharge chamber 281 is always supplied to the upper space within cylinder 371 through aperture 461. When coil 48*a* is not energized, the upper end of aperture 461 is closed by armature 48*b*. The pressure of the compressed fluid within the upper space of cylinder 371 presses an outer surface of upper portion 375 of piston 372 downward (leftward in relating to FIG. 3) against the restoring force of bias spring 39. Finally, first and second openings 373, 374 are blocked by piston 372. The communication between suction chamber 271 and intermediate pressure chamber 282 is prevented, and the compression operates normally. In this situation, the downward force of piston 372 occurred by discharge gas pressure fully overcomes the upward force of piston 372 occurred by suction gas pressure which upwardly presses the bottom portion of piston 372 and restoring force of bias spring 39.

When coil 48*a* is energized, a magnetic flux is produced around coil 48*a* and armature 48*b* is pulled up. Compressed fluid flows through to communicating channel 29 via operating chamber 482 and second conduit 462. In result, upward force of piston 372 occurred by suction gas pressure which upwardly presses the bottom portion of piston 372 and the restoring force of bias spring 39 overcomes the downward force of piston 372 occurred by reduced discharge gas pressure. Finally, first and second openings 373, 374 are opened, i.e., the communication between suction chamber 271 and intermediate chamber 282 is obtained. Thus, the compression volume decreases.

In the beginning stage of opening first and second openings 373, 374, there is no changing pressure which presses the bottom portion of piston 372. Therefore, fluttering which has happened in the prior art is completely eliminated.

Figure 4:
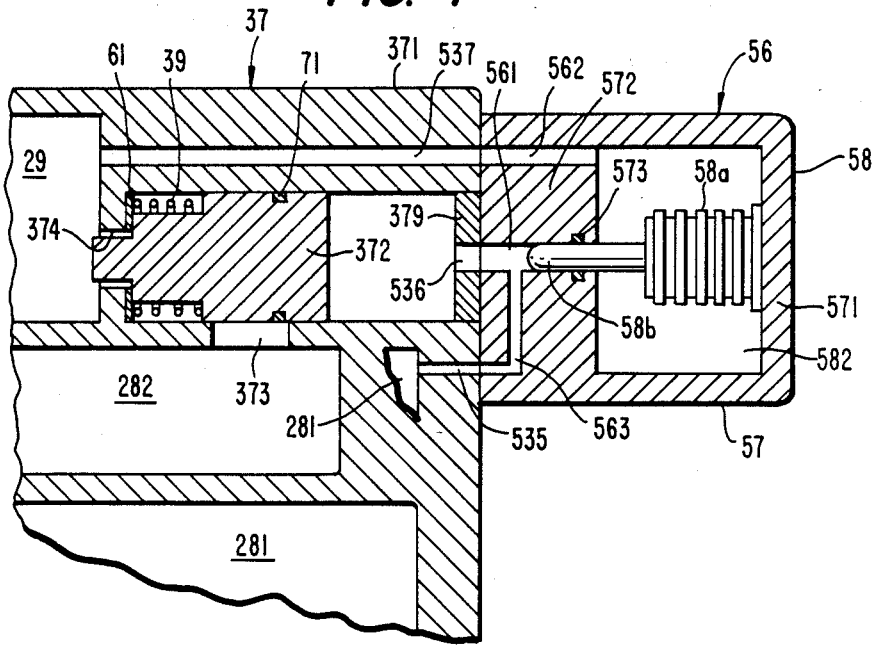
FIG. 4 is a cross-sectional view of another alternate embodiment of the variable displacement mechanism used in the scroll type compressor of FIG. 1.

Referring to FIG. 4, the third embodiment of a control mechanism 56 is shown. Control mechanism 56 comprises a first valve element 37 having cylinder 371 and piston 372 slidably disposed within cylinder 371, and a second valve element 58. Second valve element 58 is disposed on ceiling 379 of cylinder 371 and comprises a cylinder 57 and bellows 58*a*. Bellows 58*a* having a valve member 58*b* is fixed to ceiling 571 of cylinder 57. Valve member 58*b* is slidably disposed in a first conduit 561 formed at the center of a cylinder block 572. First conduit 561 communicates an upper space within a cylinder 371 and an operating chamber 582 through hole 536. A second conduit 562 formed at cylinder block 572 communicates a communicating channel 29 and operating chamber 582 through a fourth conduit 537. A third conduit 563 formed at cylinder block 572 communicates a discharge chamber 281 and first conduit 561 through a fifth conduit 535. A ring-shaped sealing member 573 is disposed on an inner peripheral surface of first conduit 561 to obtain a seal between the inner peripheral surface of first conduit 561 and an outer peripheral surface of valve member 58*b*.

In operation, when the suction gas pressure is high, i.e., heat load is large, bellows 58*a* is longitudinally contracted and moves valve member 58*b* rightward. Thus, discharge gas within discharge chamber 281 is led into the upper space of cylinder 371 via fifth circuit 535, third conduit 563, first conduit 561 and hole 536. On the other hand, when the suction gas pressure is low, i.e., heat load is small, bellows 58*a* is longitudinally expanded and moves valve member 58*b* leftward. In result, one opening end of third conduit 563 opening to first conduit 561 is closed by valve member 58*b*. Therefore, communication between discharge chamber 281 and the upper space of cylinder 371 is blocked. Then, discharge gas within the upper space of cylinder 371 can leak into communicating channel 29 through a gap between seal ring 71 and the inner peripheral surface of cylinder 371. In accordance with leakage of discharge gas within the upper space of cylinder 371, pressure of the upper space of cylinder 371 can be reduced.

A manner of first valve element 37 is similar to the first and second embodiment, so that the explanation of the manner of first valve element 37 is omitted.

We claim:

1. In a scroll type compressor including a housing having an inlet port and outlet port, a fixed scroll disposed within said housing and having a circular end plate from which a first spiral element extends into the interior of said housing, an orbiting scroll capable of being driven in an orbital motion and being prevented from rotating during the orbital motion having a circular end plate from which a second spiral element extends, said first and second spiral elements interfitting to make a plurality of line contacts and to define at least one pair of fluid pockets including a central fluid pocket within the interior of said housing, said circular end plate of said fixed scroll dividing the interior of said housing into a front chamber and a rear chamber, said front chamber communicating with said inlet port, and said rear chamber being divided into a discharge chamber, which communicates between said outlet port and the central fluid pocket, and an intermediate pressure chamber, at least one pair of holes formed through said circular end plate of said fixed scroll forming a fluid channel between the fluid pockets and said intermediate pressure chamber, a communication channel formed through said circular end plate of said fixed scroll to form a fluid channel between said intermediate pressure chamber and said front chamber, means for controlling fluid communication between said intermediate pressure chamber and said front chamber, said controlling means comprising a first valve element associated with said intermediate pressure chamber and a second valve element, said second valve element controlling a motion of said first valve element, said first valve elementcomprising a cylinder and a piston slidably disposed within said cylinder, the top of said piston of said first valve element capable of receiving pressure of compressed fluid from said discharge chamber by virtue of said second valve element, said cylinder of said first valve element having both first and second openings, said first opening formed at said intermediate pressure chamber side of said cylinder, said second opening formed at said communication channel side of said cylinder, the improvement comprising:

a bottom of said piston of said first valve element which abuts said second opening of said cylinder of said first valve element when said top of said piston of said first valve element receives compressed fluid pressure from said discharge chamber.

2. A scroll type compressor according to claim 1, wherein said second valve element is a bellows valve means disposed within said piston of said first valve element.

3. A scroll type compressor according to claim 1, wherein said second valve element is a magnetic valve means disposed upon said cylinder of said first valve element.

4. A scroll type compressor according to claim 1, wherein said second valve element is a bellows valve means disposed upon said cylinder of said first valve element.

5. A scroll type compressor as in claim 1, wherein said bottom of said piston abuts said second opening of said cylinder when said pressure on said top of said piston is greater than or equal to a predetermined pressure.

6. An assembly as in claim 1, wherein said piston further comprises a side which abuts said first opening of said cylinder of said first valve element when said bottom of said piston abuts said second opening of said cylinder.

7. An assembly as in claim 1, wherein, when said bottom of said piston is abutting said second opening of said cylinder of said first valve element, said bottom of said piston receives pressure substantially exclusively from said front chamber and said top of said piston receives pressure substantially exclusively from said discharge chamber.

8. An assembly for controlling fluid communication between an intermediate pressure chamber and a front chamber of a scroll type compressor including a communicating channel between said intermediate pressure chamber and said front chamber housing, said assembly including a first valve element and a second valve element, said first valve element having a cylinder and a piston and being associated with said intermediate pressure chamber, said cylinder having a side facing said intermediate pressure chamber and a side facing said communication channel and said cylinder having a first opening formed in the intermediate pressure chamber side of said cylinder and a second opening formed in the communicating channel side of said cylinder, said first valve element piston is slidably disposed within said cylinder with a top capable of receiving pressure of compressed fluid from a discharge chamber and said control assembly second valve element controls motion of said first valve element by applying pressure of compressed fluid from a discharge chamber to said top of said piston, the improvement comprising:

a bottom of said piston of said first valve element which abuts said second opening of said cylinder when said top of said piston receives compressed fluid from a discharge chamber.

9. An assembly as in claim 8, wherein said bottom of said piston abuts said second opening when said pressure on said top of said piston is greater than or equal to a predetermined pressure.

10. An assembly as in claim 8, wherein said piston further comprises a side which abuts said first opening of said cylinder of said first valve element when said bottom of said piston abuts said second opening of said cylinder.

* * * * *